US009228159B2

(12) United States Patent
Gaudreault

(10) Patent No.: US 9,228,159 B2
(45) **Date of Patent: *Jan. 5, 2016**

(54) HARD SURFACE CLEANING COMPOSITION

(71) Applicant: Jelmar, LLC, Skokie, IL (US)

(72) Inventor: Rosemary Gaudreault, Park Ridge, IL (US)

(73) Assignee: Jelmar, LLC, Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/039,731

(22) Filed: Sep. 27, 2013

(65) Prior Publication Data

US 2014/0066356 A1 Mar. 6, 2014

Related U.S. Application Data

(63) Continuation-in-part of application No. 12/927,377, filed on Nov. 12, 2010, now Pat. No. 8,569,220.

(51) Int. Cl.

| | |
|---|---|
| ***C11D 1/75*** | (2006.01) |
| ***C11D 3/20*** | (2006.01) |
| ***C11D 3/43*** | (2006.01) |

(52) U.S. Cl.

CPC ..... *C11D 3/2086* (2013.01); *C11D 1/75* (2013.01); *C11D 3/2068* (2013.01); *C11D 3/2079* (2013.01); *C11D 3/2082* (2013.01); *C11D 3/43* (2013.01)

(58) Field of Classification Search

CPC ..... C11D 1/75; C11D 3/042; C11D 3/2068
USPC ..... 510/238, 239, 240, 253, 433, 434, 503, 510/506

See application file for complete search history.

(56) References Cited

U.S. PATENT DOCUMENTS

| | | | | |
|---|---|---|---|---|
| 8,569,220 | B2 * | 10/2013 | Gaudreault | 510/253 |
| 2003/0019508 | A1 * | 1/2003 | Tomarchio et al. | 134/6 |
| 2012/0122757 | A1 * | 5/2012 | Gaudreault | 510/477 |

* cited by examiner

*Primary Examiner* — Brian P Mruk

(74) *Attorney, Agent, or Firm* — Richard D. Harris; Greenberg Traurig, LLP

(57) ABSTRACT

A hard surface cleaning solution having improved cleaning and descaling properties. The cleaning solution includes the following components: a first organic acid, a second organic acid, a surfactant, a solvent and a diluent. The first organic acid is a carboxylic acid, preferably lactic acid, while the second organic acid is also a carboxylic acid, preferably gluconic acid. The surfactant is selected from the group consisting of amine oxides, preferably lauramine oxide. The solvent may be an alkoxylated alcohol, preferably selected from the propylene glycol ether class of compounds.

21 Claims, No Drawings

HARD SURFACE CLEANING COMPOSITION

RELATED APPLICATION

This is a continuation-in-part application of U.S. patent application Ser. No. 12/927,377, filed on Nov. 12, 2010, now U.S. Pat. No. 8,569,220.

BACKGROUND OF THE INVENTION

1. Field of the Invention

The present invention relates in general to an improved cleaner for hard surface cleaning applications, including kitchens, bathrooms, tubs and tiles, amongst others, and more particularly to a hard surface cleaning composition having improved cleaning and descaling properties.

2. Background Art

Hard surface cleaning compositions have been known and used in a variety of applications, including bathrooms, kitchens and other areas, particularly for toilets, showers, bathtubs, sinks, tiles, countertops, walls, floors and the like. Often times, hard surfaces accumulate both soap scum stains, which are typically residues of various types of soaps used in a household, as well as hard water stains, which are typically the result of the deposition of calcium, lime or various salts on hard surfaces over the course of time and use of various household surfaces.

Cleaning solutions for these household surfaces have been formulated to address both the removal of soap scum stains, as well as the descaling of hard water stains. In particular, many of these cleaning solutions have employed a combination of components, in a number of instances including strong inorganic acids, organic acids or a combination of both, a surfactant or wetting agent, a solvent and a diluent to address one or both of these types of stains and/or build-ups. The acid component is typically selected to address descaling of hard water stains, while the surfactant component is typically a detergent selected to attack soap scum. Further, other additives have also been used in combination with cleaning formulations to either enhance performance or make a particular formulation more desirable from a visual or odor perspective, such as stabilizing agents, colorants and fragrances, amongst others.

It has also become important for cleaning solutions to be formulated in such a way as to have less impact on the environment (to be "green"). One way in which this is encouraged is through a program of the United States Environmental Protection Agency, known as the Design for the Environment Program ("DfE"). DfE certifies "green" cleaning products through the Safer Product Labeling Program. One aspect for obtaining certification is to have a cleaning solution which is less acidic, specifically, to have a pH greater than 2, for household cleaning products. Furthermore, the standards adopted by governmental agencies, or sought by consumers, have been evolving. In the future, governmental standards may require, and/or consumers may demand, even stricter standards regarding the environmental compatibility of effective hard surface cleaning solutions. While it is unknown exactly how or when changes to these standards will occur, it is believed that any such change would adhere to stricter environmental standards, requiring ever "greener" cleaning products. One such change could be the pH level of the cleaning solution, requiring the pH level to be substantially higher than the current minimum requirement of 2.0.

It is desirable to provide a cleaning solution which minimizes and/or eliminates the more corrosive inorganic acids, as well as the more corrosive organic acids, and instead uses less corrosive, but equally effective organic acids to achieve the desired cleaning results.

It is yet further desirable to find a cleaning solution with a specific combination of organic acids, surfactants and solvents which act in a synergistic manner to improve cleaning performance on hard surfaces.

SUMMARY OF THE INVENTION

The present invention is directed to a hard surface cleaning solution, which comprises a first organic acid comprising a carboxylic acid selected from the group consisting of lactic acid, glycolic acid, formic acid, citric acid and acetic acid; a second organic acid comprising a carboxylic acid different from the first organic acid and selected from the group consisting of gluconic acid, glycolic acid, formic acid, citric acid and acetic acid; a surfactant selected from the group consisting of amine oxides; a solvent selected from the group consisting of ether alcohols; and a diluent; and wherein the solution has a pH level ranging from about 2.0 to about 3.06; and wherein the surfactant does not contain salt in an amount sufficient to materially affect the pH of the hard surface cleaning solution.

In a preferred embodiment of the invention the first organic acid comprises lactic acid. The first organic acid may comprise about 5 wt. % to about 18 wt. % of the active cleaning composition. The first organic acid may comprise about 16 wt. % of the active cleaning solution.

In another preferred embodiment of the invention, the second organic acid comprises gluconic acid. The second organic acid may comprise about 1.0 wt. % to about 3.75 wt. % of the active cleaning composition. In particular, the second organic acid may comprise about 3.25 wt. % of the active cleaning solution.

In another embodiment of the invention, the surfactant comprises lauramine oxide. The surfactant may comprise about 1.5 wt. % to about 7.5 wt. % of the active cleaning composition. In particular, the surfactant may comprise about 2.00 wt. % of the active cleaning composition.

The solvent may comprise a propylene glycol ether. In particular, the solvent may comprise propylene glycol(mono) butyl ether. The solvent may comprise about 0.5 wt. % to about 3.0 wt. % of the active cleaning composition. In particular, the solvent comprises about 1.4 wt. % of the active cleaning composition.

The solution of the present invention may have a pH level of about 2.0 to about 3.06. The solution may have a pH level of about 2.2 to about 3.25, after being aged for a minimum of six months.

The solution descales marble test tiles in the range of about 1.326% to about 2.995%.

In another preferred embodiment of the invention, the solution does not contain bleach in an amount sufficient to materially affect the pH level of the solution, or in an amount to cause the formation of noxious gases.

DETAILED DESCRIPTION OF THE INVENTION

While this invention is susceptible of embodiment in many different forms, there are described several specific embodiments with the understanding that the present disclosure is to be considered as an exemplification of the principals of the invention and is not intended to limit the invention to the embodiments so described.

As the present invention is intended to be an improvement over existing hard surface cleaning solutions, it is appropriate to consider the formulations of such existing cleaning solutions.

One cleaning solution that has been sold, in the past, under the brand name CLR by Jelmar, Inc., has the following formulation:

| Ingredient | Formula % (wt. %) | % Active |
|---|---|---|
| Deionized Water | 68.8893 | N/A |
| Surfactant Mackam LHS Lauryl Hydroxysultaine (Rhodia) | 4.8500 | 2.0370 |
| Organic Acid Purac 88 L(+) Lactic Acid Technical Grade 88% Soln. (Purac America) | 18.3600 | 16.1568 |
| Organic Acid Gluconic Acid Technical Grade 50% Soln. (PMP Fermentation) | 6.5000 | 3.2500 |
| Solvent Dowanol PnB Propylene Glycol Mono-n-Butyl Ether (Dow) | 1.4000 | 1.4000 |
| Coloring Agent Pyla-Cert Green MX-817 (Pylam) | 0.0008 | 0.0008 |

The surfactant in a cleaning solution performs a very important function, which is acting to physically separate a contaminating substance, from the surface to which the contaminating substance is adhered. Then, in such a cleaner, the acids function to attack and dissolve calcium and lime (which refers generally to calcium oxide and calcium hydroxide) deposits as well as rust (iron oxide) deposits. The solvents (e.g., alcohols or ethers or otherwise, etc.) can dissolve other contaminants, such as oils and greases.

The present invention is directed to a liquid cleaning solution which is particularly suited for removing soap scum, hard water stains, lime scale and the like from various hard surfaces such as tubs, tiles, showers, sinks and other areas which are exposed to water and soap. The present invention includes a cleaning solution which is a more vigorous solution more suitable for removing hard water stains, lime scale and rust.

In a preferred embodiment of one embodiment of the present invention, the cleaning solution includes a first chelating agent, a second chelating agent, a surfactant or wetting agent, a solvent and a diluent. The first and second chelating agents are both organic acids, particularly first and second organic acids, and are preferably selected from the class of carboxylic acids. Organic acids tend to be less corrosive, more environmentally friendly and break down more rapidly than counterpart inorganic acids which are often used in cleaning solutions. The first organic acid is preferably present in an amount of about 12.0 wt. % to about 18.0 wt. %, where the percentage is based upon the active component in the overall cleaning solution composition, which convention will be used throughout this specification unless indicated otherwise. The first organic acid is preferably selected from the group of carboxylic acids including lactic acid, glycolic acid, formic acid, citric acid and/or acetic acid. Most preferably, the first organic acid comprises lactic acid in an amount of 16.2 wt. % of the solution, which is sold under the Purac 88 brand and can be purchased from Purac America, headquartered in Lincolnshire, Ill.

The second organic acid, preferably present in an amount of approximately 2.5 wt. % to about 3.75 wt % active in the formula, is also preferably a carboxylic acid such as gluconic acid, glycolic acid, formic acid, citric acid and/or acetic acid. Most preferably, the second organic acid is a polyhydroxycarboxylic acid, more preferably gluconic acid purchased under the trade name "PMP Gluconic Acid" (previously sold under the trade name "Gluconal GA-50") from PMP Fermentation, of Peoria, Ill. Of course, one of ordinary skill in the art with the present disclosure before them will readily appreciate that other carboxylic acids may also be used within the scope of the present invention.

The most preferred combination of first and second organic acids, namely lactic acid and gluconic acid, tends to be less corrosive than other combinations of organic and/or inorganic acids typically present in commercial hard surface cleaning solutions, which often include citric acid. Further, the gluconic acid is milder on the skin than many alternative acid cleaning components. Additionally, lactic acid and gluconic acid tend to have a more favorable odor than other substitute acids such as formic acid and better cleaning and descaling properties than alternative acids such as glycolic acid. Of course, the most preferred lactic and gluconic acids are also chosen as they have been found to have a synergistic compatibility with each other as well as with the surfactant system and solvent of the present invention. It is important that the organic acids are not reactive with and adverse to the surfactant system, which can cause a drop-off in effectiveness and functionality of the cleaning solution.

The surfactant is preferably an amine oxide; more preferably, lauramine oxide ("LO"), which is also known as lauryldimethylamine oxide, dodecyldimethylamine oxide, or dimethyldodecylamine-N-oxide. Lauramine oxide can be purchased under the trade name Mackamine LO from Rhodia, located in Cranbury, N.J. Other alternative sources of lauramine oxide are Macat AO-12 (from Mason Chemicals) and Ammonyx LO (from Stepan Chemical). Commercially available LO is notable because it does not contain any salt (NaCl) as a result of the production process nor does the chemical itself contain a sodium component. It is believed that surfactants that contain salt (NaCl), or sodium (Na), either as an element of the fundamental surfactant molecules, or as a production byproduct, can have a tendency to suppress the pH of the resulting cleaning solution, even when the pH of the surfactant constituent itself is fairly high (>9 or 10). However, it has also been noted that even using surfactants that clearly lacked a sodium component, either as an element in the fundamental surfactant molecule, or as part of a production byproduct, such as glycosides, which also had a high initial pH, likewise failed to elevate the pH of the final cleaning solution, when the other constituents were as set forth in Table 1 hereinbelow. Only amine oxides, particularly lauramine oxide, were found to elevate the pH to DfE certification levels (a pH of 2.0 or higher), while at the same time providing comparable cleaning performance as the reference prior art cleaning solution (CLR) mentioned above.

The solvent is an ether alcohol based solvent, and preferably an alkoxylated glycol. More preferably, the solvent is selected from a group of propylene glycol ethers, such as dipropylene glycol methyl ether, tripropylene glycol methyl ether, dipropylene glycol normal butyl ether and propylene glycol normal butyl ether. Most preferred is a propylene glycol(mono)butyl ether sold under the trade name Dowanol PnB manufactured by Dow Chemical of Midland, Mich. The solvent is preferably present in the cleaning solution in the range of about 0.50 wt. % to about 3.0 wt. % of the active formula, and most preferably in an amount of about 1.4 wt. % of the active formula. Other solvents may be chosen from glycols based on an ether of preferably the propylene type. Likewise, ethylene type glycol ethers are contemplated for use with the present invention.

The diluent is preferably deionized water, which is present in a range of about 72.0 wt. % to about 83.5 wt. % active in the cleaning solution formula. More preferably, the diluent comprises about 77.15 wt. % of the active cleaning formulation.

Other components may also be added to the cleaning solution of the present invention to add a variety of properties or characteristics, as desired. For instance, additives may include colorants, fragrance enhancers, anionic or nonionic surfactants, corrosion inhibitors, defoamers, pH stabilizers, stabilizing agents, or other additives that would be known by one of ordinary skill in the art with the present disclosure before them. For instance, a colorant is preferred for use with the present cleaning solution, which colorant takes the form of a green colorant purchased as Pyla-Cert Green MX-718, which can be purchased from Pylam Products Company, Inc. of Tempe, Ariz. Such colorant is preferably used in a quantity sufficient to provide the desired color, preferably in the amount of approximately 0.0008 wt. % of the active formula.

Corrosion inhibitors may also be incorporated into the cleaning solution. The preferred class of corrosion inhibitors are imidazolines such as tall oil hydroxyethyl imidazoline, capryl hydroxyethyl imidazoline, cocoyl hydroxyethyl imidazoline, lauryl hydroxyethyl imidazoline and oleyl hydroxyethyl imidazoline. Of course, other corrosion inhibitors may also be used, as would be known by one of ordinary skill in the art with the present disclosure before them. Other additives such as the above described corrosion inhibitors or nonionic surfactants are added in quantities sufficient to impart the desired properties to the cleaning solution, as would be known by those of ordinary skill in the art with the present disclosure before them.

The cleaning solution according to the first embodiment of the present invention described immediately above has a pH of 2.0 or greater, which enables the solution to achieve DfE certification. The cleaning solutions according to the present invention are typically bottled in plastic containers, and used by wiping (or other direct application) the cleaning composition onto the surface of a tub, tile, sink shower or other surface to be cleaned.

The following example is given to illustrate the cleaning composition of the present invention, but are not intended to limit the invention to the examples included herewith. The following example below specifically illustrates exemplary and preferred formulations of the cleaning composition according to the present invention. It is to be understood that the examples are presented by means of illustration only and that further use of formulations that fall within the scope of the present invention and the claims herewith may be readily produced by one skilled in the art with the present disclosure before them.

Preparation of the Cleaning Solution Formulation

An example formulation illustrating an embodiment of the inventive cleaning composition of the present invention is described in detail in Table I below and was formulated generally in accordance with the following protocol.

Example 1

Cleaning Solution Formulation 1

A cleaning solution according to the first embodiment of the present invention was prepared, by introducing appropriate amounts of the indicated constituents, so as to attain the desired relative weight percentages indicated in Table 1 hereinafter, by first charging deionized water into a tank equipped with a mixer. Lactic acid, in the form of Purac 88-T, was then added to the deionized water in the tank. Next, gluconic acid, in the form of PMP Gluconic Acid, were added into the tank. After addition of the gluconic acid, lauramine oxide, in the form of Mackamine LO, were added to the tank from below the surface of the liquid in the tank to minimize foaming. In production, it is preferred to pump the surfactant in through the bottom of a stainless steel tank. After the contents of the tank were mixed thoroughly, the propylene glycol(mono) butyl ether solvent was added into the stainless steel tank in the form of Dowanol PnB. Finally, Plya-Cert Green MX-718 colorant was added to the mixture to achieve the desired color.

Inasmuch as various ones of the raw material components of the cleaning solution are purchased in a form that is at least partially diluted with water, Table 1 provides the percentage of each component which is active in the raw material, the percentage of each particular component (active material and any water in the raw material solution) in the formula and the percentage of each component in the active portion of the formula.

TABLE 1

Cleaning Solution Formulation 1

| Ingredient Name | % Active in Raw Material | % in Formula | % Active in Formula |
|---|---|---|---|
| Deionized Water | | 67.06920 | N/A |
| Purac 88 Lactic Acid | 88 | 18.36000 | 16.16 |
| PMP Gluconic Acid Gluconic Acid | 50 | 6.50000 | 3.25 |
| Mackamine LO Lauramine Oxide (Rhodia) | 30 | 6.67000 | 2.00 |
| Dowanol PnB Propylene Glycol (Mono) Butyl Ether | 100 | 1.40000 | 1.40 |
| Pyla-Cert Green MX-718 | 100 | 0.00080 | 0.00080 |

Testing of Example Cleaning Solution Formulation

The hard surface cleaning solution of the present invention was evaluated for rust removal efficacy. Cleaning Formulation 1 was subjected to testing by an independent laboratory to measure the formulation's ability to remove rust stain from white ceramic tiles, according to a standardized test method (Specialized Technology Resources—STR Test Method Number L/PS-TM-241—Rust Stain Removal Procedure), and was found to provide an average rust removal rate of 83.4%. Similar testing of a known prior art cleaning solution, conventional Jelmar CLR full strength cleaning solution, yielded an average rust removal rate of only 69.5%.

In addition, comparison testing of the cleaning solution of the present invention and the prior art CLR solution on various materials to determine the effect of the cleaning solution on various substrates demonstrated that the cleaning solution of the present invention either produced less, or at least no more adverse affect (e.g., discoloration, change in gloss, blistering, softening, swelling, loss of adhesion, etc.) than the reference cleaning solution.

Accordingly, the present invention has been found to provide more effective rust stain removal as compared with a known prior art cleaning solution, while at the same time producing comparable or fewer adverse surface affects, and providing an elevated pH reaching 2.10 or greater (as compared to the pH of <2 of the prior art CLR solution)—resulting in a more environmentally friendly product.

Range of pH Levels and Descaling Ability

One of skill in the art can appreciate the maximum pH of the solution of Table 1 above, as calculated from the manufacturer's publicly available information about the exact components used in the solution, is about 2.4. However, upon varying the relative concentrations of each ingredient in the formula, the hard surface cleaning solution of the present invention may have an even greater pH level, while still effectively removing soap scum together with calcium, lime and rust from hard surfaces. A hard surface cleaning solution having a higher pH level may be required by future regulations or environmental standards, or may be preferred by consumers who prefer a less acidic compound with which to effectively remove calcium, lime and rust. Table 2 sets forth further compositions of the present invention, their pH levels, and their respective results from descaling testing, using a descaling testing method that is described below. Each formula below was created using an organic acid solution consisting of 83.26% lactic acid (Purac 88) and 16.74% gluconic acid (PMP Gluconic Acid), which was added to the solution in the concentration given below. In addition to the surfactant lauramine oxide (Mackamine LO) added in the concentration given below, each solution further contains the same amount of solvent Dowanol PnB, 1.4%, with the remainder of each solution made up of the diluent, deionized water.

TABLE 2

| Formula No. | Organic Acid, % | Lauramine Oxide, % | pH | Descale, % |
|---|---|---|---|---|
| JEL-1552 | 19.41 | 2.00 | 2.04 | 2.995 |
| JEL-1805 | 19.41 | 4.00 | 2.20 | 2.780 |
| JEL-1815 | 16.50 | 4.50 | 2.37 | 2.622 |
| JEL-1812 | 13.59 | 5.00 | 2.55 | 2.518 |
| JEL-1813 | 13.59 | 7.50 | 2.75 | 2.082 |
| JEL-1810 | 7.76 | 5.00 | 2.81 | 1.882 |
| JEL-1811 | 5.82 | 5.00 | 3.06 | 1.326 |

Each of the solutions above were tested for both their pH level, and descaling ability. The pH level was determined by a pH meter (Corning pH Meter 440 with Corning Pinnacle 3 in 1 Premium Gel Combo Electrode, Corning Inc., Corning, N.Y.) on formulations tested shortly after creation—that is formulations that were not aged. The descaling tests in Table 2 were performed according to a different method from the STR test method described above in Table 1. For Table 2, the descaling tests were performed upon marble test blocks, namely Crema Tumbled Marble Tiles, 9/16"×9/16"×3/8". Marble was chosen because it contains calcium carbonate, or limestone. Thus, solutions that descale calcium, lime and rust, must also react with marble and dissolve a portion of it into solution. Before testing, the blocks were prepared by washing them in distilled water, and drying them in an oven at 120° C. (248° F.). The blocks were then stored in a closed jar to prevent the absorption of moisture before testing. When ready for testing, the blocks were weighed, and placed in a beaker with 15 g of identified cleaning solution being tested. After 5 minutes, the blocks were removed from the cleaning solution being tested, patted dry, and washed several times with distilled water to remove any remaining cleaning solution. Then, the blocks were dried in an oven at 105° C. (221° F.) for an hour to remove moisture, and allowed to cool for another hour before weighing. The percentage of descaling was calculated through the difference in weight of the marble block, before and after testing, as follows:

$$\text{Descale, \%} = (\text{Initial Weight} - \text{Final Weight}) \times 100 / \text{Initial Weight}$$

Each of the cleaning solutions of Table 2 were also evaluated for soap scum removal, in a qualitative test described below. Lightly colored (off white), low gloss, 2"×2" ceramic tiles were coated with a heavy solution of 50% Oil of Olay Anti-Aging Body Wash (Procter & Gamble Co., Cincinnati, Ohio) and 50% tap water, and then set aside for two weeks to dry, to simulate the deposit of a layer of soap scum. A paper towel was then soaked in the tested cleaning solution for 3 seconds, and then immediately applied to the soiled tile, and scrubbed for 10 seconds. The tile was then wiped by a dry paper towel for another 10 seconds, and set aside to dry for 12 hours before inspection under good light. Each of the cleaning solutions of Table 2 were found to completely remove the soap scum from the tiles, under these parameters.

As noted above in Table 2, the cleaning solutions each descaled the marble blocks, to varying degrees. The formula used in the first solution, JEL-1552, closely matches that of the commercially available CLR® Calcium, Lime and Rust Remover by Jelmar, Inc., which is well known to effectively descale calcium, lime and rust. In comparison to this formula, descaling ability decreased when tested against solutions of higher pH levels. While a higher descaling performance is preferable, there may be other considerations in choosing the appropriate ingredient concentrations of the cleaning solution, including the relative cost of each ingredient, the level of descaling that is necessary, and the pH level of the cleaning solution. Notably, if the standards for pH levels were to increase, or if consumers' preferences should change towards using a less acidic hard surface cleaning solution, the concentrations of the ingredients of the present invention cleaning solution may be altered to still provide an effective hard surface cleaning solution, one that is effective at both removing soap scum as well as descaling calcium, lime and rust.

pH Levels Drift Higher Over Time

The pH levels of the cleaning solutions of the present invention have been observed to change over time. Namely, the pH levels have been observed to drift higher, with aging of the cleaning solution itself. In accord with convention, the pH levels disclosed in Table 2 in the present application and the claims hereto (unless otherwise distinguished), as well as those disclosed in Table 1, all refer to the pH levels of the solutions as measured when each solution was first created. However, solutions that are stored six months or longer, and have been measured at that time, have been observed to have a higher pH level, than the pH level, as measured when the solution was first created. To quantify the unexpected shift in pH level, different solutions of the present invention have been oven-aged to simulate the effects of storage for a longer period of time at room temperature, as shown in Table 3 below.

TABLE 3

| Formula No. | Initial pH | Oven-Aged pH |
|---|---|---|
| Cleaning Solution Formulation 2 | 2.10 | 2.30 |
| JEL-1811 | 3.06 | 3.25 |

Cleaning Solution Formulation 2 is a version of cleaning solution that has been sold commercially as CLR® Calcium, Lime and Rust Remover by Jelmar, Inc. The composition of JEL-1811, also of the invention, has a composition that is described above in association with Table 2. As noted above, both solutions are capable of removing calcium, lime and rust, at different degrees, as well as soap scum to the same degree. To simulate aging, each of the solutions was placed in an oven for 19 days at 50° C. Oven-aging at 40° C. has been used to simulate the aging of cosmetic products at a rate of eight times the actual time at room temperature. Oven-aging at 50° C. has been used to simulate aging at a rate that is 50% higher than aging at 40° C., or twelve times the actual time at room temperature. Therefore, 19 days at 50° C. simulates the aging of the solutions, for approximately 7½ months. This simulated result was confirmed by testing CLR® Calcium, Lime and Rust Remover solutions that had actually been aged more than six months, at room temperature, whose pH levels were similarly found to rise by about 0.2 units of pH.

Testing of Additional Constituents

Additional constituents were added to the hard surface cleaning solution of the present invention to determine their effect on the solution. Hydrogen peroxide bleach was added to the JEL-1552 formula disclosed above, in a concentration of 2.00% $H_2O_2$. Following the addition of peroxide, the solution suddenly appeared cloudy, or hazy. This is believed to be the result of a reaction between the hydrogen peroxide, a powerful oxidizing agent, and one or more of the constituents of the hard surface cleaning solution. After adding the peroxide, the pH of the resulting solution dropped from 2.04 to 1.95. It is believed that this occurs because the hydrogen peroxide reacted with the surfactant lauramine oxide to form lauric acid or a derivative thereof. The descaling ability of the solution increased slightly, from 2.995% to 3.057% in marble block testing, for an increase of 2.1%. This slight increase is likely due to the lower pH level, which has notably dropped below 2.0, the minimum pH level required for DfE certification. Thus, the addition of hydrogen peroxide bleach is also not recommended.

Further, sodium hypochlorite bleach was added to the JEL-1552 formula disclosed above. Two ml of Clorox® bleach (The Clorox Company, Oakland, Calif.) containing 8.25% sodium hypochlorite were added to 60 ml of the JEL-1552 formula, in a well-ventilated area. A reaction was witnessed upon the addition of the bleach, which resulted in what was believed to be the production of chlorine gas. A noxious gas emitted from the solution, that, despite all of the precautions taken, was still pungent and irritating to the upper respiratory tract and eyes. Such an experiment should not be repeated outside of a highly ventilated hood. Thus, one should avoid adding any chlorine bleach, such as sodium hypochlorite, to the hard surface cleaning solution of the present invention.

The foregoing description merely explains and illustrates the invention, and the invention is not limited thereto, except as those skilled in the art who have the present disclosure before them will be able to make modifications and variations therein without departing from the scope of the invention.

The invention claimed is:

1. A hard surface cleaning solution for descaling calcium, lime and rust, comprising:

a first organic acid comprising a carboxylic acid selected from the group consisting of lactic acid, glycolic acid, formic acid, citric acid and acetic acid;

a second organic acid comprising a carboxylic acid different from the first organic acid and selected from the group consisting of gluconic acid, glycolic acid, formic acid, citric acid and acetic acid;

a surfactant selected from the group consisting of amine oxides;

a solvent selected from the group consisting of ether alcohols; and a diluent;

wherein the solution has a pH level ranging from greater than 2.4 to about 3.25;

wherein the surfactant does not contain salt in an amount sufficient to materially affect the pH and the descaling ability of the hard surface cleaning solution;

wherein the solution effectively descales calcium, lime and rust.

2. The hard surface cleaning solution of claim 1 wherein the first organic acid comprises lactic acid.

3. The hard surface cleaning solution of claim 1 wherein the first organic acid comprises about 5 wt. % to about 18 wt. % of the active cleaning composition.

4. The hard surface cleaning solution of claim 3 wherein the first organic acid comprises about 16 wt. % of the active cleaning solution.

5. The hard surface cleaning solution of claim 1 wherein the second organic acid comprises gluconic acid.

6. The hard surface cleaning solution of claim 1 wherein the second organic acid comprises about 1.0 wt. % to about 3.75 wt. % of the active cleaning composition.

7. The hard surface cleaning solution of claim 6 wherein the second organic acid comprises about 3.25 wt. % of the active cleaning solution.

8. The hard surface cleaning solution of claim 1 wherein the surfactant comprises lauramine oxide.

9. The hard surface cleaning solution of claim 1 wherein the surfactant comprises about 1.5 wt. % to about 7.5 wt. % of the active cleaning composition.

10. The hard surface cleaning solution of claim 9 wherein the surfactant comprises about 2.00 wt. % of the active cleaning composition.

11. The hard surface cleaning solution of claim 1 wherein the solvent comprises a propylene glycol ether.

12. The hard surface cleaning solution of claim 11 wherein the solvent comprises propylene glycol (mono) butyl ether.

13. The hard surface cleaning solution of claim 1 wherein the solvent comprises about 0.5 wt. % to about 3.0 wt. % of the active cleaning composition.

14. The hard surface cleaning solution of claim 13 wherein the solvent comprises about 1.4 wt. % of the active cleaning composition.

15. The hard surface cleaning solution of claim 1 further including an additive selected from the group consisting of colorants, fragrance enhancers, nonionic surfactants, corrosion inhibiting agents, defoamers, pH stabilizers and stabilizing agents.

16. The hard surface cleaning solution of claim 1 having a pH level ranging from greater than 2.4 to about 3.06, as measured before aging.

17. The hard surface cleaning solution of claim 1 having a pH level, of greater than 2.4 to about 3.25, as measured after said cleaning solution has been aged for a minimum of six months.

18. The hard surface cleaning solution of claim 1 wherein the solution descales marble test tiles in the range of about 1.326% to about 2.995%.

19. The hard surface cleaning solution of claim 1 wherein the solution does not contain bleach in an amount to materially affect the pH level of the solution.

20. The hard surface cleaning solution of claim 1 wherein the solution does not contain bleach in an amount to cause the formation of noxious gases.

21. A hard surface cleaning composition for descaling calcium, lime and rust, comprising:

lactic acid, in an amount of about 5 wt. % to about 18 wt. % of the active cleaning composition;

gluconic acid, in an amount of about 1.0 wt. % to about 3.75 wt. % of the active cleaning composition;

an amine oxide, in an amount of about 1.5 wt. % to about 7.5 wt. % of the active cleaning composition;

propylene glycol (mono) butyl ether, in an amount of about 0.5 wt. % to about 3.0 wt. % of the active cleaning composition;

deionized water, in an amount of about 72.0 wt. % to about 87.8 wt. % of the active cleaning composition;

wherein the composition has a pH ranging from greater than 2.4 to about 3.06, as measured before aging;

wherein the surfactant does not contain salt in any an amount sufficient to materially affect the pH and the descaling ability of the hard surface cleaning solution;

wherein the solution effectively descales calcium, lime and rust.

* * * * *